US006119996A

United States Patent [19]

Connery

[11] Patent Number: 6,119,996

[45] Date of Patent: Sep. 19, 2000

[54] HIGHCHAIR HELPER

[76] Inventor: Mente P. Connery, 632 E. Amelia St., Orlando, Fla. 32803

[21] Appl. No.: 09/138,889

[22] Filed: Aug. 24, 1998

Related U.S. Application Data

[60] Provisional application No. 60/090,373, Jun. 22, 1998.

[51] Int. Cl.[7] ..... A47K 1/08

[52] U.S. Cl. ..... 248/311.2; 248/102; 248/312; 297/174

[58] Field of Search ..... 248/311.2, 102, 248/103, 230.4, 230.1, 231.51, 301, 306, 307, 309, 312, 312.1, 316.7, 225.21, 278.1, 188.2; 297/174, 188.2; 224/482; 108/46

[56] References Cited

U.S. PATENT DOCUMENTS

| | | | |
|---|---|---|---|
| D. 154,271 | 6/1949 | Heim | D15/1 |
| D. 208,317 | 8/1967 | Broder | D44/10 |
| D. 303,454 | 9/1989 | Morales et al. | D3/40 |
| 1,660,743 | 2/1928 | Carroll . | |
| 1,786,902 | 12/1930 | Doughty . | |
| 1,937,994 | 12/1933 | Taylor | 45/75 |
| 2,707,141 | 4/1955 | Witter | 311/103 |
| 2,711,872 | 6/1955 | Lampke | 248/103 |
| 3,143,374 | 8/1964 | Carboni | 297/188 |
| 3,338,628 | 8/1967 | Evans | 297/188.2 |
| 3,475,052 | 10/1969 | Kaposi | 297/153 |
| 3,904,041 | 9/1975 | Medgebow | 248/315 X |
| 4,403,786 | 9/1983 | Ulics | 280/289 |
| 4,548,440 | 10/1985 | Meslin | 297/174 |
| 4,560,128 | 12/1985 | Willeby | 248/230 |
| 4,854,638 | 8/1989 | Marcus et al. | 297/250 |
| 4,858,796 | 8/1989 | Roth | 224/42.44 |
| 4,961,555 | 10/1990 | Egan | 248/231.8 |
| 5,106,046 | 4/1992 | Rowles et al. | 248/311.2 |
| 5,148,755 | 9/1992 | Morales | 248/311.2 X |
| 5,170,981 | 12/1992 | Lin | 248/311.2 |
| 5,211,607 | 5/1993 | Fermaglish et al. | 472/15 |
| 5,244,175 | 9/1993 | Frankel | 248/215 |
| 5,257,765 | 11/1993 | Halle | 248/222.1 |
| 5,279,452 | 1/1994 | Huynh | 248/311.2 |
| 5,624,095 | 4/1997 | Zissu | 248/231.81 |
| 5,996,507 | 12/1999 | Joseph | 108/46 |

*Primary Examiner*—Ramon O. Ramirez
*Assistant Examiner*—Tan Le
*Attorney, Agent, or Firm*—Brian S. Steinberger; Law Offices of Brian S. Steinberger

[57] ABSTRACT

Detachable bottle and food holding subtrays and clamps for attaching onto the raised ridge edges on trays used in highchairs, strollers, booster chairs, and activity chairs. The clamps can be a single component having a curved upper flange for fitting about the raised ridge of the existing tray, and an upper bent flange having an end which abuts against a lower surface of the tray. Dual cylindrical bottle subtray holders and flat planar food subtray holders can snap onto the clamp leaving the bottles and food in the subtrays at a lower level than that of the tray out of reach of a sitting child. Another clamp has a general C-shape with either a screwable post or spring biased post locking the clamp to the raised edge of the existing tray.

17 Claims, 7 Drawing Sheets

HIGHCHAIR HELPER

This invention relates to highchairs and strollers, and in particular to a detachable device for attaching to tray edges on highchairs, booster chairs, activity chairs and stroller type chairs for holding baby bottles, food and the like, out of reach of a sitting child, instead of using existing table and countertop surfaces, and claims priority to U.S. Provisional application 60/090,373 filed Jun. 22, 1998.

BACKGROUND AND PRIOR ART

Feeding a baby can be extremely messy. When using a traditional highchair for feeding, the person feeding the seated infant usually must handfeed the infant holding the jar of food in one hand, while spoon feeding the baby with the other hand. This handholding of the food jar is necessary since the infant has a tendency to reach across the tray width, and knock objects within their reach. Knocked down jars of baby food can be extremely messy to cleanup, as well as resulting in wasted unusable food spilled out from the jar. Additionally, the person feeding the infant must use both of their hands at all times during the feeding process.

Additionally, the feeding of infants also requires a baby bottle filled with milk, juice and the like, to be used. For similar reasons, baby bottles cannot be temporary stored on the existing tray since the bottles are within easy reach of the infant and can be knocked down creating additional messes and wasted liquids. The problem comes into play when the person feeding the infant must temporarily place the bottle somewhere if they are going to start handfeeding the infant using a handheld food jar, bowl and handheld spoon.

Similar problems occur with other chairs having trays such as infant booster chairs, stroller type chairs, stationary and movable activity chairs, and the like.

To obviate the problems above, the person feeding the infant has had to temporarily place the bottle, food jar, and/or spoon on floor surfaces, adjacent tables and/or countertops. However, this temporary solution creates other problems. In addition to taking up additional space, these surfaces need to be completely clean (bacteria and bug free) to store these objects, and generally require an extra cleanup after the jars, bottles, and spoons have been placed on these surfaces.

Various proposals have been made over the years but fail to solve the problems presented above. U.S. Patents Des.208,317 to Broder; 3,143,374 to Carboni; 3,475,052 to Kaposi; and 4,548,440 to Meslin et al. each describe attaching small plate trays to existing highchair trays. However, each of these references requires placing the small plate trays on top of the existing tray putting the small plate trays within easy reach of the infants, and not solving any of the problems presented above.

U.S. Pat. No. 2,711,872 to Lampke describes a telescoping arm with a clamp end for use with baby crib railings. However, Lampke's clamp cannot be used to attach their device over and about the top raised lip edges and bottom of the tray edge on traditional highchair and stroller trays. Furthermore, the arm and clamp mechanism can be potentially harmful to the infant if left unattended.

U.S. Pat. No. 1,660,743 to Carroll; U.S. Pat. No. 1,937,994 to Taylor; and U.S. Pat. No. 2,707,141 to Witter each describe tray attachment devices for attaching to the edges of tables. However, none of these patents has a clamp that allows the device to simultaneously wrap about the top raised lip edge and bottom edge on traditional highchairs and stroller trays. Using these devices would create unstable tray attachments. Furthermore, these devices would leave the food jars and bottles at the same height as that of the existing trays themselves. Thus, objects stored on these devices would still be within reach of seated infants.

Thus, the need exists for a solution to the above stated problems.

SUMMARY OF THE INVENTION

The primary objective of the present invention is to provide a detachable device for attaching to a tray edge on highchairs, booster chairs, and strollers for holding baby bottles, food and the like, out of reach of a sitting child, in place of using the surfaces of tables and countertops.

The secondary objective of this invention is to provide a detachable device that can be easily attached and removed to all tray edges on existing high chairs, booster chairs and strollers.

The third objective of this invention is to provide an attachment device for the trays on highchairs, booster chairs and strollers that reduces the spillage of foods/liquids during infant feeding.

The fourth objective of this invention is to provide an attachment device for the trays on highchairs and strollers that allows bottles and food jars to be cleanly and safely stored.

The fifth objective of this invention is to provide an attachment device for the trays on high chairs and strollers that can easily be cleaned within a dishwasher, and used within a microwave.

A preferred embodiment of the detachable device includes a clamp having an upper portion for attaching about an upper raised ridge of a tray situated in front of a sitting child, a lower portion for abuting against a lower surface of the tray, and an exterior side having brackets for allowing a bottle holder subtray or a food subtray to be attached thereto. The tray can be part of an existing highchair, a stroller, a booster chair and an activity chair. The upper portion of the clamp can include a planar plate extending over the raised ridge of the tray and a downwardly protruding portion for contacting a surface of the tray inside the raised ridge. The lower portion of the clamp can further include either a screwable post fastener that can abut up against the lower surface of the tray, or a spring biased post fastener.

Another version of the clamp can include a curved flange having a generally C-cross-sectional shape with a channel opening in the flange for wrapping about the raised edge of the tray, a side wall having an upper end connected to the flange, the side wall being adjacent to an exterior surface of the raised edge of the tray, and an upwardly bending flange connected to a lower end of the sidewall, the upwardly bending flange having a portion which abuts against the lower surface of the tray, wherein the clamp means snaps into a lock position about the raised edge and the lower surface of the tray.

A removable shield can be inserted between the bottle/food holder subtrays and the clamps for blocking the sitting child from reaching the food and the liquid. The food subtray can include a substantially flat subtray having raised side edges, and a rear wall perpendicular to the subtray, the rearwall having an upper hook end for attaching to a receiving portion in the exterior wall of the clamp means, the rear wall having a lower end connected to the subtray, wherein the subtray is at a lower level than that of the tray. The bottle holder subtray can include a substantially flat subtray having openings for supporting a baby bottle therein, and a rear wall perpendicular to the subtray, the rearwall having an upper hook end for attaching to a receiving portion in the exterior wall of the clamp means, the rear wall having a lower end connected to the subtray, wherein the subtray is at a lower level than that of the tray. The bottle holder subtray can further include dual cylinders openings for supporting a baby bottle therein, and a rear wall perpendicular to the dual cylinders, the rearwall having an upper hook end for attaching to a receiving portion in the exterior wall of the clamp means, the rear wall having a lower end connected to the dual cylinders, wherein the dual cylinders are at a lower level than the tray.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figures 1, 2:
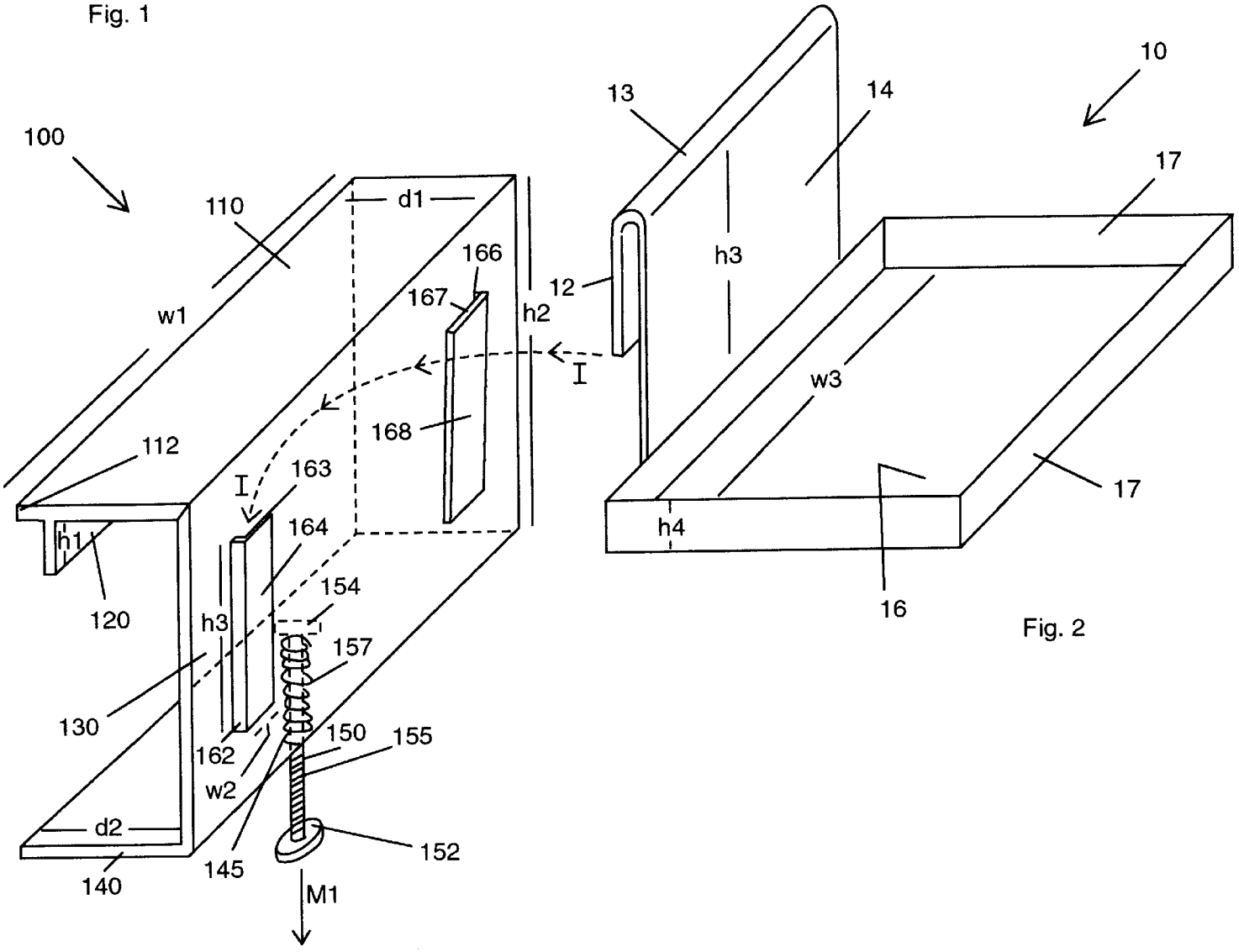
FIG. 1 is a perspective view of a first preferred embodiment of the tray edge adjustable clamp of the subject invention for use with trays on highchairs, booster chairs, activity chairs and strollers.
FIG. 2 is a perspective view of a food subtray attachment for use with the edge clamp of FIG. 1.

FIG. 1 is a perspective view of a first preferred embodiment 100 of the tray edge adjustable clamp of the subject invention for use with trays on highchairs, booster chairs, activity chairs and strollers. Clamp 100 includes an upper planar horizontal plate 110 having a width W1, of approximately 4 and ¼ inches, a depth d1, of approximately 1 and ½ inches. Perpendicular to plate 110 is a downwardly projecting lip 120 has a height h1, of approximately ½ of an inch, which is approximately ½ inch inside of upper plate edge 112, grips about an upper raised ridge of a tray which is shown in greater detail in later described drawings. Perpendicular to a rear edge of horizontal plate 110 is a vertical plate 130 having a height h2, of approximately 3 inches. On the exterior side of vertical plate 130 are dual L-shaped brackets 162, 164 and 166, 168. Each bracket has vertical side portions 162, 166 having a height h3 of approximately 1½ inches with inwardly projecting clip walls 164, 166 having a width W2 of approximately 1 inch, and having open channels 163, 167 formed therebetween. Perpendicular to vertical plate 130 is bottom plate 140(which is parallel to upper plate 110, having a depth d2, of approximately 1½ inches. A post 150 is inserted within a middle portion of bottom plate 140, and has an upper flattened end 154 which can have a expandable spring 157 between flattened end 154 and upper surface of bottom plate 140. On the opposite end of post 152 is a second flattened end 152 which can be moved by the user downward in the direction of arrow M1 so that clamp 100 is fit about tray edges of the highchair, stroller, activity chairs and booster chair which are shown and described in the other figures. Alternatively, post 150 can have threads 155 which allow the post to be screwed through bottom opening 145 within plate 140.

FIG. 2 is a perspective view of a food subtray attachment 10 for use with the edge clamp 100 of FIG. 1. Referring to FIG. 2, subtray 10 includes a hook portion 13 and downwardly protruding end-wall 12 having a substantially C-cross-sectional shape. Attached to hook portion 12–13 is a rearwall 14 having a height h3, of approximately 2 to approximately 3 inches, with a planar plate subtray 16 perpendicularly attached thereto. Plate subtray 16 can have a width W3, of approximately 3 to approximately 5 inches and four vertical side-walls 17 each having a height h4 of approximately ¼ to ½ of an inch. To use, end-wall 12 is inserted in the direction of arrow I1 into channel openings 163, 167 until the undersurface of hook top 13 abuts against the top edges of clip walls 164, 168. The bottom surface 16 of FIG. 2 can support the bottom of bottles, jars and bowls as well as be able to directly hold food and/or liquids therein.

Figure 3A:
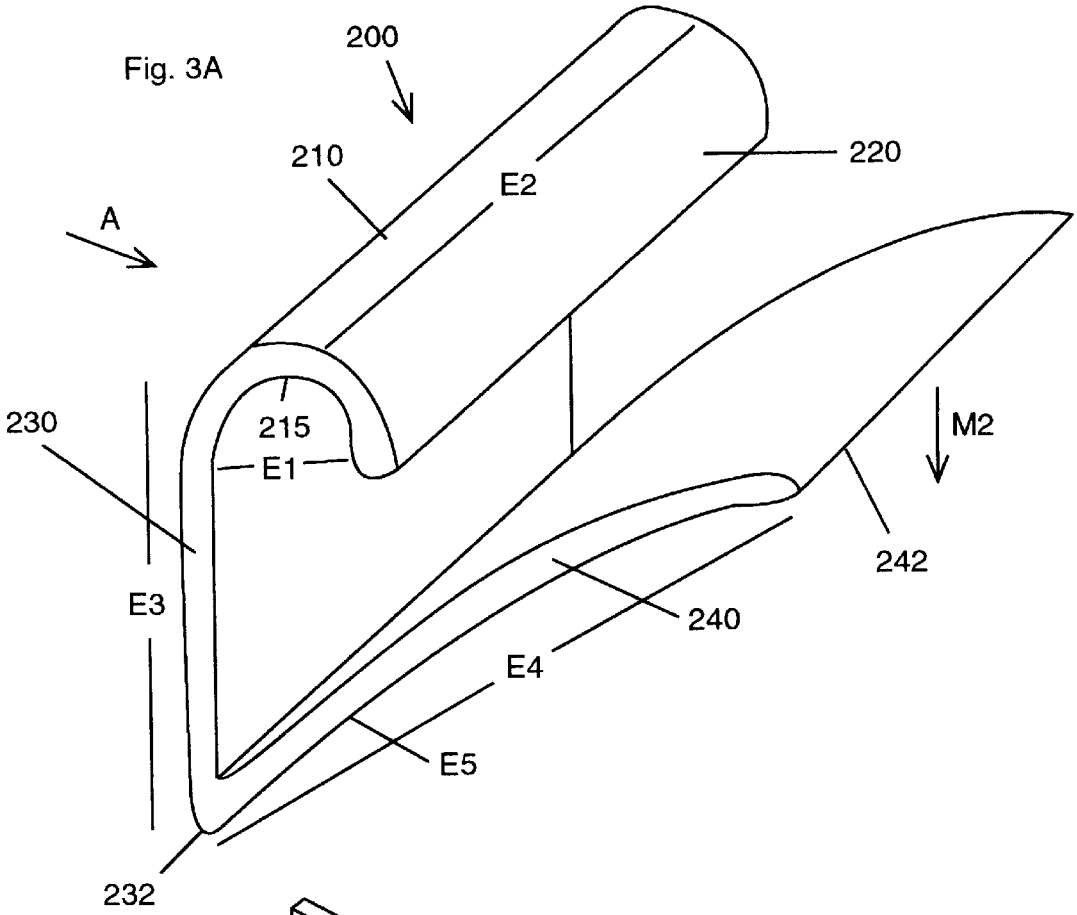
FIG. 3A is a perspective view of a second preferred embodiment of the tray edge expandable clamp of the subject invention for use with trays on highchairs, booster chairs, activity chars and strollers.

FIG. 3A is a perspective view of a second preferred embodiment 200 of the tray edge expandable clamp of the subject invention for use with trays on highchairs, booster chairs, activity chars and strollers. Referring to FIG. 3A, expandable clamp 200 includes downwardly curved flange 210 with rounded lip tip 220 attached to a rear-wall 230. The diameter E1 between lip 220 and rear-wall 230 being approximately 1 inch in diameter. On the exterior side of rear-wall 230 are dual clip brackets 262, 264, 266, 268 which correspond to like components in the preceding figures. Small inwardly protruding dimples 261, 269 allow the subtray attachments to have a tighter fit to clamp 200. The width E2 of clamp 200 can be approximately 3 inches and the height E3 of rear-wall 230 can be approximately 2⅝ inches. Connected to the lower end of rear wall 230 is an upwardly slightly concave bending flange plate 240 having an angle E5 of approximately 1 to 5 degrees, having an end 242 with a height E4, of approximately 1¾ inches above bottom 232. End 242 can be bent down in the direction of arrow M2 when attaching the clamp 200 about the tray edges in the applications to be later described.

Figure 3B:
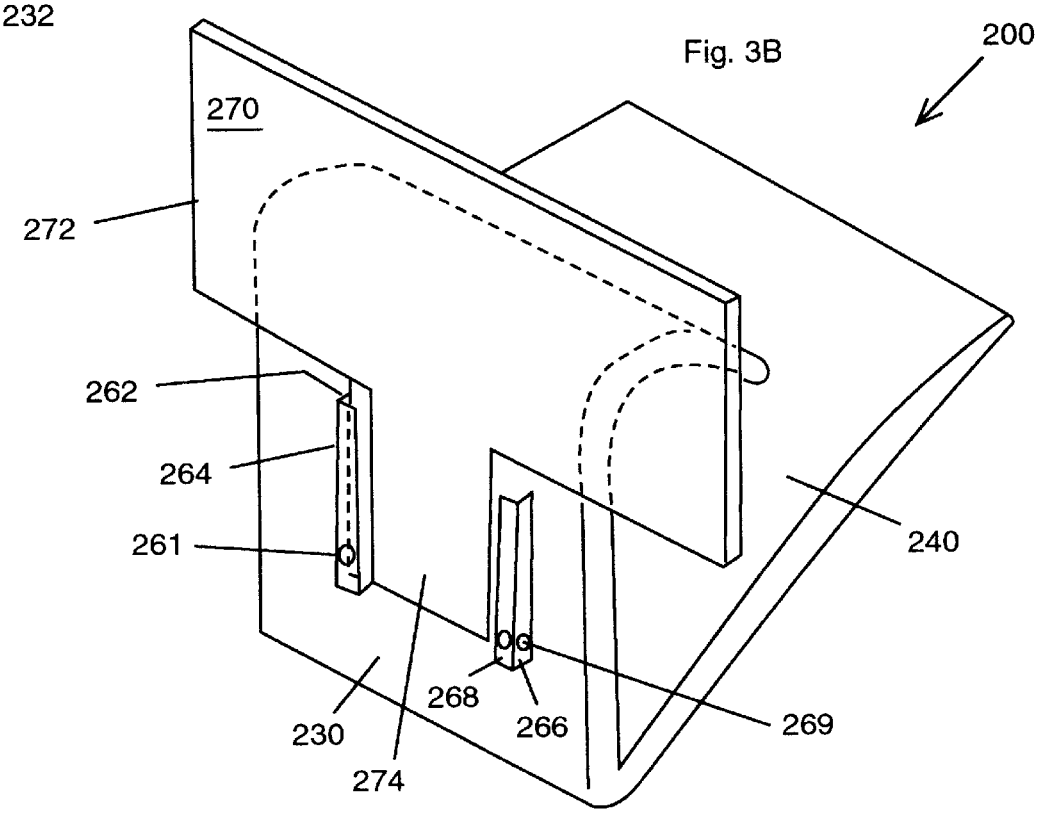
FIG. 3B is a rear view of the expandable clamp of FIG. 3A along arrow A, with a removable shield.

FIG. 3B is a rear view of the expandable clamp 200 of FIG. 3A along arrow A, with a removable shield plate 270 having a general T-shape with a bottom leg 274 that is sized to fit between 264, 268 brackets. In use upper horizontal plate 272 of plate 270 aids as a shield to block a childs access to the contents of the subtrays 10, 20 and 30 described in this invention.

Figure 4:
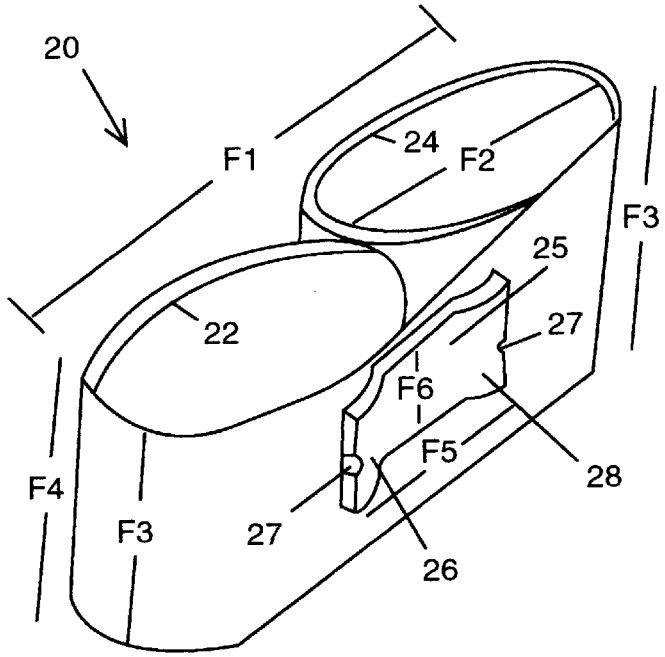
FIG. 4 is a perspective view of a bottle holder subtray attachment with mechanical lock in tab connector for use with the clamps of FIGS. 1 and 3A–3B.

FIG. 4 is a perspective view of a bottle holder subtray attachment 200 with mechanical lock in tab connector 26 for use with the clamps of FIGS. 1 and 3A–3B. Referring to FIG. 4, subtray 200 includes plastic injection molded dual side-by-side cylinders 22, 24 having a width across the front F1 of approximately 5 inches, with each cylinder having an inner diameter opening F2, of approximately 2¾ inches. The side and rear heights F3 of dual cylinders 22, 24 can be approximately 2½ inches, while the front height F4 of dual cylinders 22, 24 can have a height of approximately 2¾ inches (the greater height in the front allows for baby bottles to be more securely mounted inside the cylinders 22, 24). On the rear of dual cylinders 22, 24 can be a rectangular tab 25 having slightly angled outwardly bent edges 26, 28, the latter having indented cut-outs 27 therein for locking about dimples 261, 269 of clamp 200 of FIGS. 3A–3B.

Figure 5:
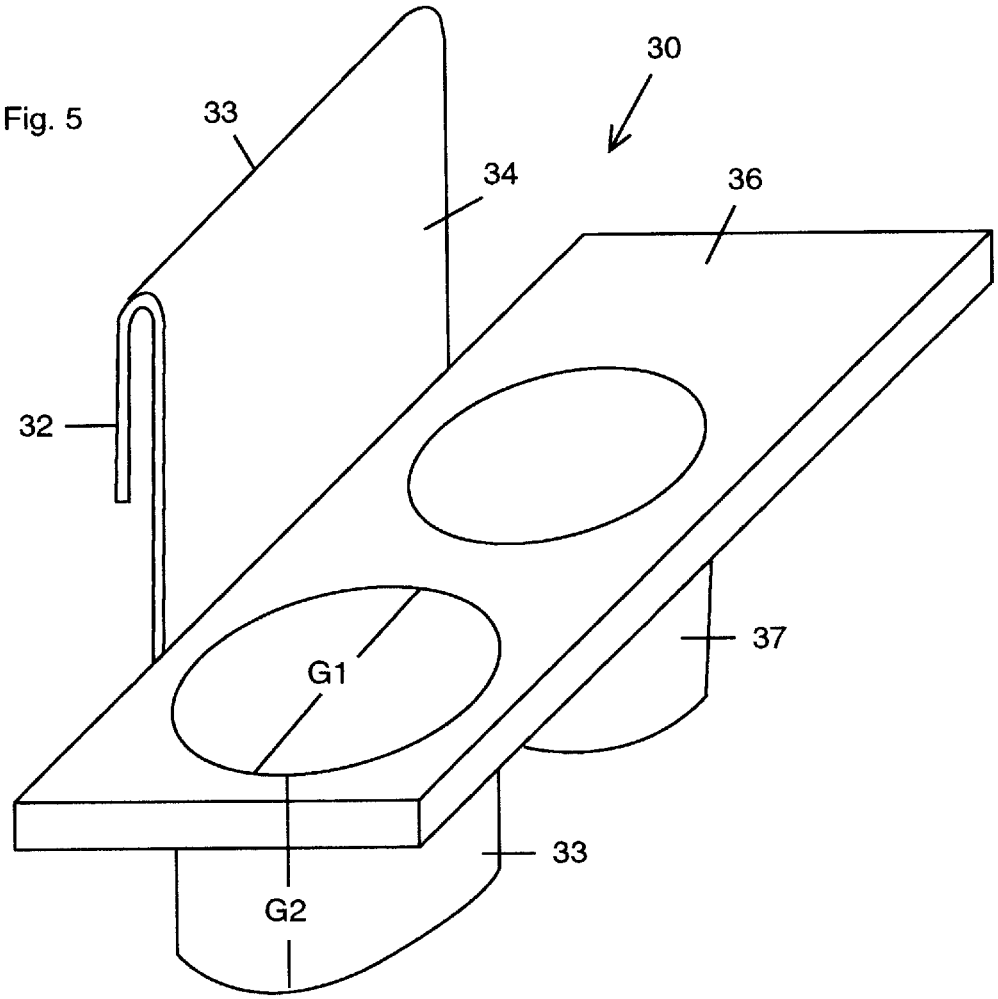
FIG. 5 is a perspective view of another bottle holder subtray attachment with hook tab connector for use with the clamps of FIGS. 1 and 3A–3B.

FIG. 5 is a perspective view of another bottle holder subtray attachment 30 with hook tab connector for use with the clamps of FIGS. 1 and 3A–3B. Subtray attachment 30 includes a hook portion 33 and downwardly protruding end-wall 32 having a substantially C-cross-sectional shape. Attached to hook portion 32–33 is a rearwall 34 with a planar plate subtray 36 perpendicularly attached thereto and having dimensions similar to those of FIG. 2. Referring to FIG. 5, plate subtray 36 includes cylinders 33, 37, the latter having similar dimensions to cylinders 22, 24 described in reference to FIG. 4. To use end-wall 32 of attachment 30 is inserted in the direction of arrow I1 into channel openings 163, 167 shown in FIG. 1 or within brackets 264, 268 shown in FIGS. 3A–3B.

Figure 6:
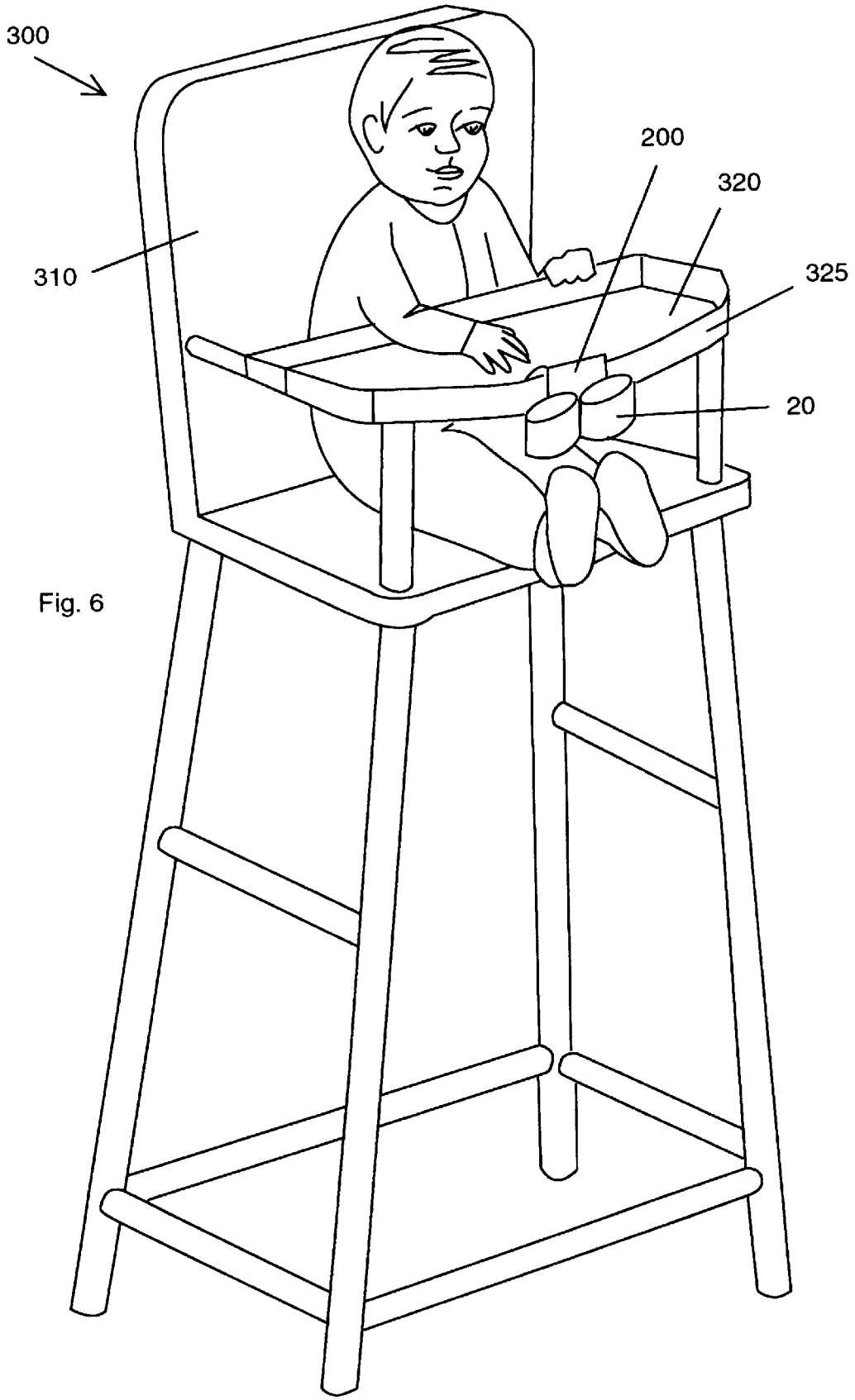
FIG. 6 is a perspective view of the bottle holder subtray attachment of FIG. 4 supported by the clamps of FIGS. 1 and 3 attached to a tray on a highchair.

FIG. 6 is a perspective view 300 of the bottle holder subtray attachment 20 of FIG. 4 supported by the clamp 200 of FIGS. 1 and 3 attached to a raised edge 325 of a tray 320 on a highchair 310.

Figure 7:
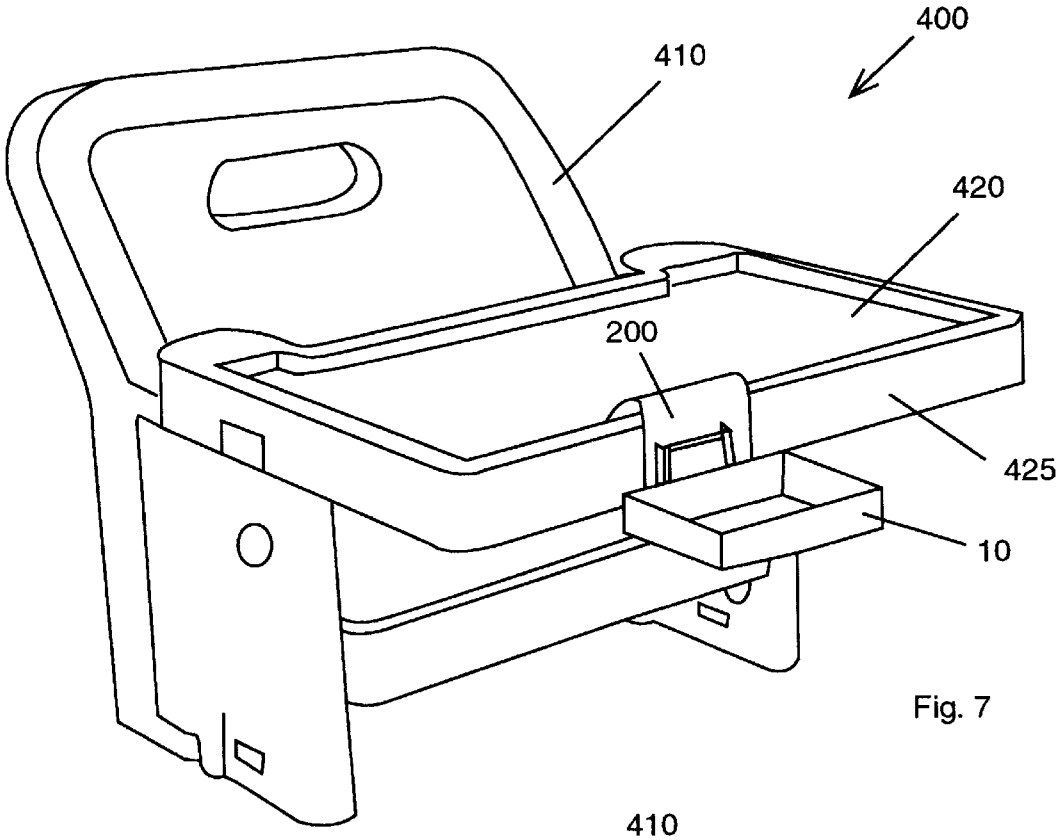
FIG. 7 is a perspective view of the attachment clamp of FIG. 3A with the food subtray of FIG. 2 attached to a booster chair.

FIG. 7 is a perspective view 400 of the attachment clamp 200 of FIG. 3A with the food subtray 10 of FIG. 2 attached to a raised edge 425 of tray 420 on a booster chair 410.

Figure 8:
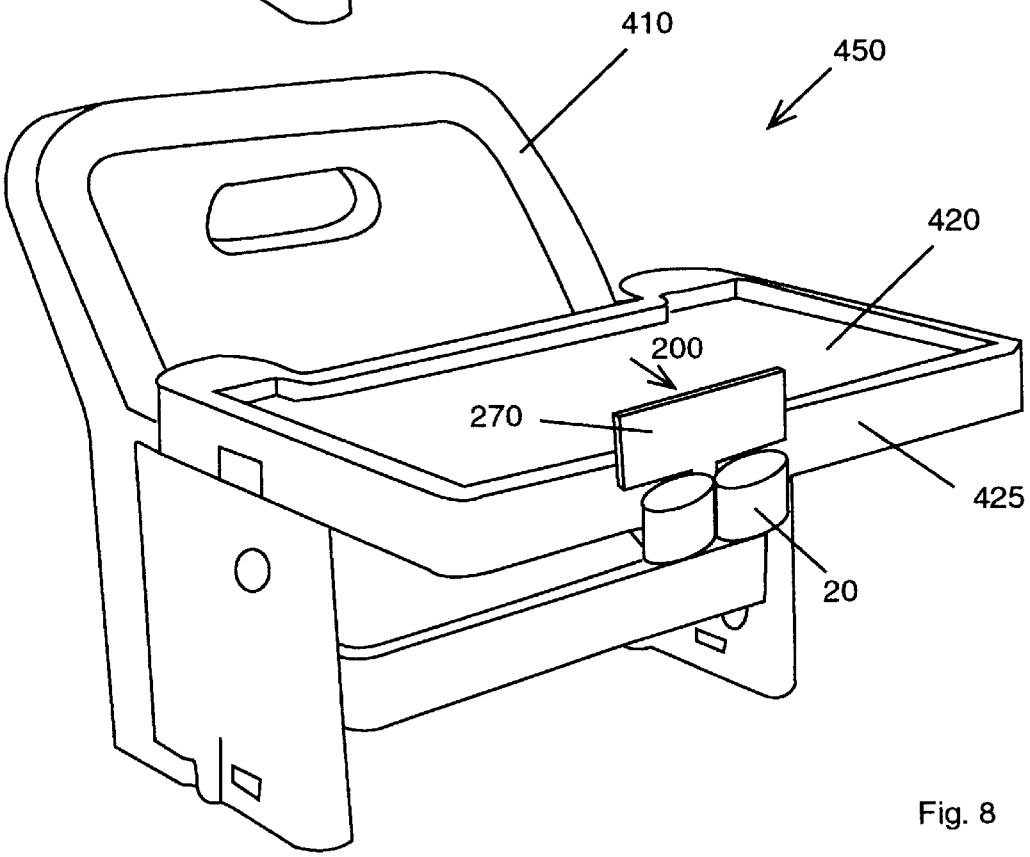
FIG. 8 is a perspective view of the attachment clamp and shield of FIG. 3B with the dual cylinder bottle holder of FIG. 4 attached to a booster chair.

FIG. 8 is a perspective view 450 of the attachment clamp 200 and shield 270 of FIG. 3B with the dual cylinder bottle holder 20 of FIG. 4 attached to a raised edge 425 of tray 420 on a booster chair 410. Removable shield 270 slides between dual cylinder holder 20 and clamp 200 when used.

Figure 9:
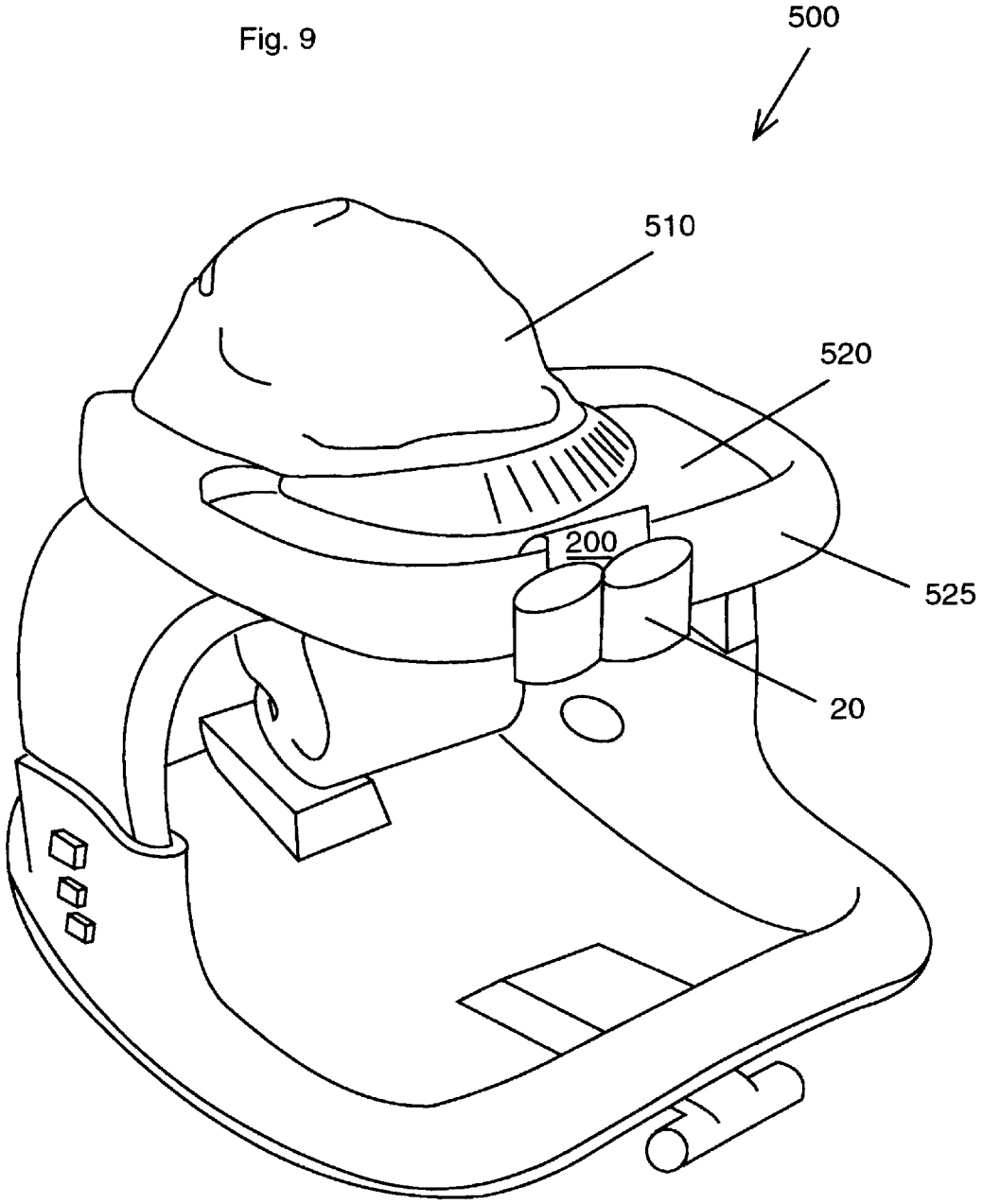
FIG. 9 is a perspective view of the attachment clamp of FIG. 3B with dual cylinder bottle holder of FIG. 4 attached to a stationary activity chair.

FIG. 9 is a perspective view 500 of the attachment clamp 200 of FIG. 3B with dual cylinder bottle holder 20 of FIG. 4 attached to raised edge 525 of tray 520 on stationary activity chair 510.

Figure 10:
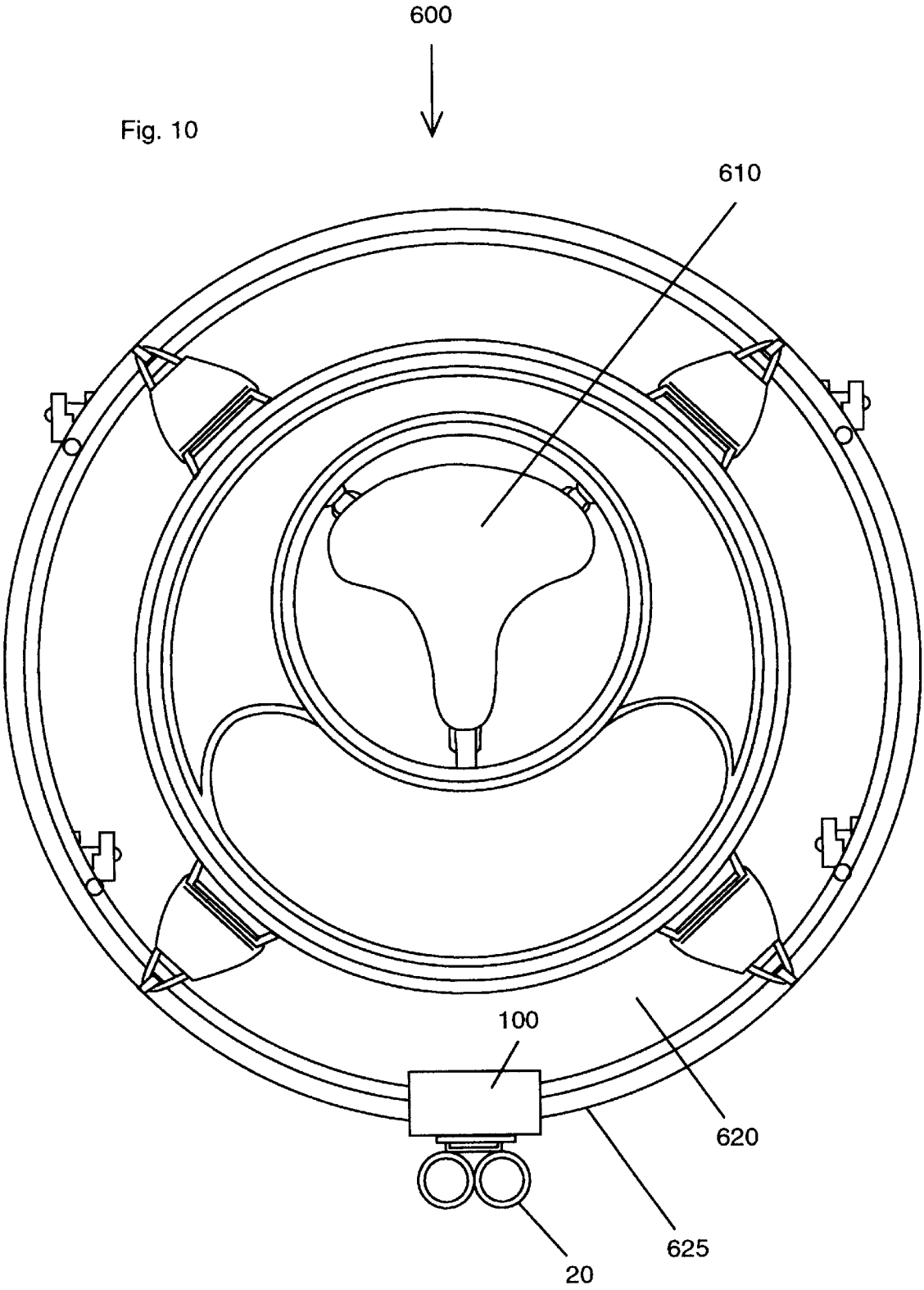
FIG. 10 is a perspective view of the attachment clamp of FIG. 1 with dual cylinder bottle holder of FIG. 4 attached to a movable activity chair.

FIG. 10 is a perspective view 600 of the attachment clamp 100 of FIG. 1 with dual cylinder bottle holder 20 of FIG. 4 attached to a raised edge 625 of round tray 620 on movable activity chair 610.

The removable food and bottle holders can also include a plugable drainage hole in the bottom surface.

The materials used to make the above described invention can be made from injection molded plastics, ceramic, aluminum, galvanized metal, combinations thereof, and the like, that can be easily detachable and washable within a dishwasher. If made from plastic and ceramic, the components can be useable within microwaves when the heating of food and liquid is needed.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A detachable device for tray edges, the device comprising:

a curved flange having a generally C cross-sectional shape with a channel opening in the flange for wrapping about an upper raised ridge of a tray situated adjacent to a seat;

a side wall having an upper end connected to the flange, the side wall being adjacent to an exterior surface of the raised edge of the tray;

an upwardly bending flange connected to a lower end of the side wall, having an end portion for abutting against a lower surface of the tray; and a holder means for attaching to the side wall, the holder means for supporting food and liquid off the tray, wherein the holder means supports the food and the liquid out of reach of someone sitting in the seat.

2. The detachable device for tray edges of claim 1, wherein the upper means and the lower means of the clamp means are formed from:

aluminum.

3. The detachable device for tray edges of claim 1, wherein the upper means and the lower means of the clamp means are formed from:

injection molded plastic.

4. The detachable device for tray edges of claim 1, wherein the channel opening in the flange includes:

a diameter of approximately 1 inch.

5. The detachable device for tray edges of claim 4, wherein the sidewall includes:

a height of approximately 2 to approximately 3 inches.

6. The detachable device for tray edges of claim 1, wherein the upwardly bending flange includes:

a vertical height of at least approximately 1 and ¾ of an inch.

7. The detachable device for tray edges of claim 1, further comprising:

a vertical shield for being inserted between the clamp means and the holder means, the shield for blocking the sitting child from reaching the food and the liquid.

8. The detachable device for tray edges of claim 1, wherein the holder means includes:

a substantially flat subtray having raised side edges; and a rear wall perpendicular to the subtray, the rearwall having an upper hook end for attaching to a receiving portion in the exterior wall of the clamp means, the rear wall having a lower end connected to the subtray, wherein the subtray is at a lower level than that of the tray.

9. The detachable device for tray edges of claim 1, wherein the holder means includes:

a substantially flat subtray having openings for supporting a baby bottle therein; and a rear wall perpendicular to the subtray, the rearwall having an upper hook end for attaching to a receiving portion in the exterior wall of the clamp means, the rear wall having a lower end connected to the subtray, wherein the subtray is at a lower level than that of the tray.

10. The detachable device for tray edges of claim 1, wherein the holder means includes:

dual cylinders openings for supporting a baby bottle therein; and a rear wall perpendicular to the dual cylinders, the rear-wall having an upper hook end for attaching to a receiving portion in the exterior wall of the clamp means, the rear wall having a lower end connected to the dual cylinders, wherein the dual cylinders are at a lower level than the tray.

11. The detachable device for tray edges of claim 1, wherein the holder means includes:

a subtray for supporting food and liquid therein; and a rear wall perpendicular to the subtray, the rearwall having an upper hook end for attaching to a receiving portion in the exterior wall of the clamp means, the rear wall having a lower end connected to the subtray, and protrusions extending sideways in the rear wall for locking the rear wall in the receiving portion in the exterior wall of the clamp means, wherein the subtray is at a lower level than that of the tray.

12. A detachable device for tray edges, the device comprising:

a clamp means having an upper means, a lower means, and an exterior side, the upper means for attaching about an upper raised ridge of a tray adjacent to a seat, the lower means for being adjustably moveable to abut against a lower surface of the tray, the lower means being chosen from one of a screwable fastener and a spring biased post; and a holder means for attaching to the exterior side of the clamp means, the holder means for supporting food and liquid off the tray, wherein the holder means supports the food and the liquid out of reach of someone sitting in the seat.

13. The detachable device for tray edges of claims 12, wherein the screwable fastener includes:

a top end which abuts against a lower surface of the tray, and a lower end which can be adjusted to move the fastener up and down.

14. The detachable device for tray edges of claim 12, wherein the spring biased post includes:

a top end which abuts against a lower surface of the tray, and a lower end which allows the post to be moved away from the tray.

15. A detachable device for tray edges, the device comprising:

a clamp means having an upper means, a lower means, and an exterior side, the upper means for attaching about an upper raised ridge of a tray adjacent to a seat, the lower means abutting against a lower surface of the tray;

a holder means for attaching to the exterior side of the clamp means, the holder means for supporting food and liquid off the tray, wherein the holder means supports the food and the liquid out of reach of someone sitting in the seat; and a vertical shield for being inserted between the clamp means and the holder means, the shield for blocking the sitting someone from reaching the food and the liquid.

16. A detachable device for tray edges, the device comprising:

a clamp means having an upper means, a lower means, and an exterior side, the upper means having a curved flange with a generally C cross-sectional shape and a channel opening in the flange for wrapping about an upper raised ridge of a tray adjacent to a seat, the lower means having an upwardly angled flange for abutting against a lower surface of the tray;

a holder means for attaching to the exterior side of the clamp means, the holder means for supporting food and liquid off the tray, wherein the holder means supports the food and the liquid out of reach of someone sitting in the seat, the holder means further includes:

a substantially flat subtray.

17. A detachable device for tray edges, the device comprising:

a clamp means having an upper means, a lower means, and an exterior side, the upper means for attaching about an upper raised ridge of a tray situated in front of a seat, the lower means abutting against a lower surface of the tray;

a holder means for attaching to the exterior side of the clamp means, the holder means for supporting food and liquid off the tray, wherein the holder means supports the food and the liquid out of reach of a someone sitting in the seat, the holder means further includes:

a subtray for supporting food and liquor therein; and a rearwall perpendicular to the subtray, and protrusions extending sideways in the rearwall for locking the rearwall to a receiving portion in the exterior wall of the clamp means.

* * * * *